US007471288B2

(12) United States Patent
Hayafuji et al.

(10) Patent No.: US 7,471,288 B2
(45) **Date of Patent: *Dec. 30, 2008**

(54) LIGHT EMITTING DISPLAY DEVICE AND DRIVING CONTROL METHOD THEREFOR

(75) Inventors: Akinori Hayafuji, Yonezawa (JP); Katsuhiro Kanauchi, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 691 days.

This patent is subject to a terminal disclaimer.

(21) Appl. No.: 11/050,733

(22) Filed: Feb. 7, 2005

(65) Prior Publication Data

US 2005/0179627 A1 Aug. 18, 2005

(30) Foreign Application Priority Data

Feb. 12, 2004 (JP) ..... 2004-034401

(51) Int. Cl.
*G09G 5/00* (2006.01)

(52) U.S. Cl. ..... 345/213; 345/76; 345/80; 345/84; 345/204; 345/211

(58) Field of Classification Search ..... 345/55, 345/76, 80, 82, 84, 204, 211, 212, 213
See application file for complete search history.

(56) References Cited

U.S. PATENT DOCUMENTS 6,858,992 B2 * 2/2005 Park et al. ..... 315/169.3
7,042,164 B2 * 5/2006 Yazawa ..... 315/169.3
7,088,319 B2 * 8/2006 Yoshida et al. ..... 345/82
(Continued)

FOREIGN PATENT DOCUMENTS

CN 1404599 A 3/2003
(Continued)

OTHER PUBLICATIONS

Chinese Office Action dated Jul. 20, 2007, issued in corresponding Chinese Patent Application No. 200510008058.1 and a partial English translation.

*Primary Examiner*—My-Chau T Tran
(74) *Attorney, Agent, or Firm*—Westerman, Hattori, Daniels & Adrian, LLP.

(57) ABSTRACT

A clock signal in synchronization with a data writing signal, every scanning line, which is supplied from a light-emitting control circuit 4 to a scanning driver 6, is supplied to an oscillator 12 which generates a reference switching signal, according to a PWM method, in a DC-DC converter 8. Thereby, the timing at data writing every scanning line is in synchronization with the phase of a ripple component superimposed on a driving voltage Va from the DC-DC converter 8. Accordingly, a problem that there is caused a state in which light-emitting intensity is different every scanning line can be solved because the same voltage Vgs between a gate and a source is supplied every scanning line to a light-emitting driving transistor Tr2 at any time even if the ripple component by switching of the DC-DC converter is superimposed on the driving voltage Va. Thereby, a problem that the display quality of images is remarkably reduced can be prevented in a light-emitting driving operation of a display panel, wherein the operation has a configuration in which an organic EL element with a light-emitting intensity characteristic of a current dependence type, for example, is used as a pixel.

15 Claims, 6 Drawing Sheets

U.S. PATENT DOCUMENTS

| | | | | |
|---|---|---|---|---|
| 7,176,872 | B2 * | 2/2007 | Kuriki | 345/98 |
| 2004/0113907 | A1 * | 6/2004 | Lee et al. | 345/211 |
| 2005/0190128 | A1 * | 9/2005 | Hayafuji | 345/76 |
| 2005/0237001 | A1 * | 10/2005 | Hayafuji | 315/169.2 |

FOREIGN PATENT DOCUMENTS

| | | |
|---|---|---|
| JP | 2002-366101 | 12/2002 |
| JP | 2003-316315 | 11/2003 |
| WO | WO 01/61677 A1 | 8/2001 |

* cited by examiner

LIGHT EMITTING DISPLAY DEVICE AND DRIVING CONTROL METHOD THEREFOR

BACKGROUND OF THE INVENTION

1. Field of the Invention

The present invention relates to a light-emitting display device provided with a display panel on which active driving of light-emitting elements forming pixels are performed by, for example, thin film transistors (TFTs), and, especially, to a light-emitting display device, and a driving control method therefor, by which deterioration in image quality displayed can be effectively prevented by a ripple component which is superimposed on a driving power of the display panel.

2. Description of the Related Art

Development of a light-emitting display device using a display panel with a configuration in which light-emitting elements are arranged like a matrix has been widely promoted, and, for example, an organic electroluminescence (EL) element which uses an organic material for a light-emitting layer has received widespread attention as a light-emitting element used for such a display panel. The background for such attention is that the organic EL element has higher efficiency and longer life by using an organic compound, which is expected to have preferable characteristics fit for practical use, for a light-emitting layer of the EL element.

A direct matrix type display panel on which the EL elements are simply arranged like a matrix, and an active element comprising the TFT are added to each of the EL elements arranged like a matrix an active matrix type display panel have been proposed as a display panel using such an organic EL element. The power consumption of the latter active matrix type display panel can be lower than that of the former direct matrix type display panel. Moreover, the latter panel has characteristics such as less crosstalk between pixels, and is suitable, especially, for a high resolution display forming a large screen.

FIG. 1 shows one example of a light-emitting display device provided with a basic circuit structure corresponding to one pixel on a conventional active matrix type display panel, and a driving circuit for the circuit structure, and a power supply circuit which supplies driving power to the display panel provided with many pixels which have been described above. Here, a display panel 1 shown in the drawing has a circuit structure including one pixel 2 on account of limited space. The circuit structure including one pixel 2 is the most basic pixel configuration called a conductance controlled method, and the configuration uses an organic EL element as a light-emitting element.

That is, a gate electrode (Hereinafter, simply called a gate) of an N channel type selection scanning transistor Tr1 comprising TFT is connected to a scanning line (scanning line A1), and, a source electrode (Hereinafter, simply called a source) is connected to a data line (data line B1).

Moreover, the drain electrode (hereinafter, simply called drain) of the above selection scanning transistor Tr1 is connected to the gate of a P channel type light-emitting driving transistor Tr2, and, at the same time, to one terminal of a capacitor Cs for charge conservation.

The light-emitting driving transistor Tr2 has a configuration in which the source is connected to the other terminal of the capacitor Cs, and, at the same time, driving power Va (hereinafter, also called a driving voltage Va) from a DC-DC converter described below is supplied to the source through a power supply line P1 arranged on the display panel 1. Moreover, the drain of the light-emitting driving transistor Tr2 is connected to the anode terminal of an organic E1 element E1, and the cathode terminal of the organic EL element E1 is connected to a reference potential point (ground) in the example shown in FIG. 1.

According to the circuit structure of the pixel 2, the selection scanning transistor Tr1 is put into an ON-state when a selection voltage Select is supplied to the gate of the selection scanning transistor Tr1 through the scanning line A1 in an address period (data writing period). Then, a current corresponding to a data voltage Vdata flows from the source to the drain in the selection scanning transistor Tr1 when the data voltage Vdata corresponding to writing data from the data line B1 is supplied to the source of the selection scanning transistor Tr1. Accordingly, the above-described capacitor Cs is charged in a period in which the selection voltage Select is applied to the gate of the transistor Tr1, and the charging voltage is corresponding to the data voltage Vdata.

On the other hand, the charging voltage at which the above-described capacitor Cs is charged is supplied to the above-described light-emitting driving transistor Tr2 as a gate voltage, and a current based on the gate voltage and the driving voltage Va supplied through the power supply line P1 which is the source voltage flows from the drain to the EL element E1 in the light-emitting driving transistor Tr2 to drive the EL element E1 for light-emitting by the drain current.

Here, when the addressing operation corresponding to one scanning line is completed, and the gate potential of the selection scanning transistor Tr1 reaches an OFF voltage, the transistor Tr1 concerned is put into a so-called cut-off state, and the drain side of the transistor Tr1 is put into an open state. However, the voltage of the light-emitting driving transistor Tr2 is kept at the gate voltage by charges accumulated in the capacitor Cs, the same driving current is maintained before the data voltage Vdata is rewritten in the subsequent address period, and the light-emitting state, which is based on this driving current, of the EL element E1 is continued.

The configuration of the pixel 2 forms a dot matrix type display panel on which multiple pixels are arranged on the display panel 1 shown in FIG. 1 like a matrix, and each pixel 2 is formed at intersecting positions of scanning lines A1, - - - , and data lines B1, - - - .

Image signals displayed in the light-emitting display panel 1 is supplied to a light-emitting control circuit 4 shown in FIG. 1. In this light-emitting control circuit 4, based on horizontal, and vertical synchronizing signals in the image signals, input image signals are converted into corresponding pixel data every one pixel through sampling processing for sequential writing operation into a not-shown frame memory. Then, in an address period after the writing processing of pixel data for one frame into a frame memory is completed, serial pixel data, which has been read out from the frame memory every one scanning line described above, and shift clock signals are supplied to a shift register and data latch circuit 5*a* in a data driver 5 one by one.

This shift register and data latch circuit 5*a* has a configuration in which pixel data corresponding to one horizontal scanning is taken for latching, using the shift clock signals, and a latch output corresponding to one horizontal scanning is supplied to a level shifter 5*b* as parallel data. By the above configuration, data voltage Vdata corresponding to the pixel data is configured to individually be supplied to the source of the selection scanning transistor Tr1 forming each pixel 2. And, the operations are repeated everyone scanning in the address period.

Moreover, a scanning shift clock signal corresponding to the horizontal synchronizing signal is supplied from the light-emitting control circuit 4 to the scanning driver 6 in the address period. This scanning shift clock signal is supplied to a shift register 6*a* and to generate a register output one by one. Then, the register output is converted with a level shifter 6*b* to a predetermined operation level, and is output to the scanning lines A1 - - - . By this operation, the selection voltage Select is configured to be supplied to the gate of the selection scanning transistor Tr1 forming each pixel 2 every scanning line one by one.

Accordingly, every one scanning in the address period, the selection voltage Select is supplied from the scanning driver 6 to each pixel 2 arranged on the scanning line in the display panel 1 is supplied. The data voltage Vdata is supplied to pixels 2 arranged every scanning line from the level shifter 5*b* in the data driver 5 in synchronization with the above supplying, and the gate voltage corresponding to the data voltage Vdata is written into each pixel corresponding to the scanning lines concerned (that is, the capacitors Cs). Then, an image corresponding to one frame is reproduced on the display panel 1 by execution of the above operations for all the scanning line.

On the other hand, the driving voltage Va is configured to be supplied from a DC-DC converter (DC: direct current) represent by a reference numeral 8 to each pixel 2 arranged on the display panel 1 through the power supply line P1, - - - . Moreover, according to the configuration shown in FIG. 1, the DC-DC converter 8 is configured to boost the output of a DC voltage source Ba on the primary side, using a pulse width modulation (PWM) control method.

This DC-DC converter 8 has a configuration in which PWM waves output from a switching regulator circuit 9 performs ON control of a MOS type power field effect transistor (FET) Q1 as a switching element at a predetermined duty cycle. That is, electric power energy from the DC voltage source Ba on the primary side is accumulated in an inductor L1 by ON operation of the power FET Q1. By OFF operation of the power FET Q1, the electric power energy accumulated in the inductor L1 is accumulated in a smoothing capacitor C1 through a diode D1. Then, the boosted DC output can be obtained as a terminal voltage of the capacitor C1 by repeating the ON and OFF operations of the power FET Q1.

The DC output voltage is divided by a thermistor TH1 for temperature compensation, and resistances R11 and R12, and is supplied to an error amplifier 10 in the switching regulator circuit 9. In this error amplifier 10, the divided output is compared with a standard voltage Vref, and an compared output (error output) is supplied to a PWM circuit 11. A triangular wave for PWM is generated, based in an oscillation signal from an oscillator 12, in this PWM circuit 11. This PWM wave performs a switching operation of the power FET Q1 for feedback control in such a way that the output voltage is kept at a predetermined driving voltage Va. Accordingly, the output voltage of the DC-DC converter, that is, the driving voltage Va can be represented by the following Formula 1:

$$Va = Vref \times [(TH1 + R11 + R12)/R12] \quad \text{(Formula 1)}$$

Here, the pixel configuration shown in FIG. 1 and the configuration of the driving circuit in the pixel configuration have been disclosed in Japanese Patent Publication No. 2003-316315 which was filed by the present inventor, and the DC-DC converter shown in FIG. 1 has also been disclosed in Japanese Patent Publication No. 2002-366101 which was filed by the present inventor.

Incidentally, a drain current Id by which the organic EL element E1 is driven for light-emitting is decided by a difference voltage (voltage between the gate and the source of the transistor Tr2=Vgs) between the driving voltage Va supplied through the power supply line P1 and the gate voltage of the driving transistor Tr2 decided by charges accumulated in the capacitor Cs in the configuration of the pixel 2 shown in FIG. 1. FIG. 2 shows an equivalent circuit for the pixel configuration. In FIG. 2, a switch SW1 is substituted for the selection scanning transistor Tr1 which has already been explained. Moreover, in FIG. 2 the data voltage Vdata transmitted through the data line B1 is equivalently represented by the gate voltage Vgate of a changeable voltage source.

Here, the boosting voltage of the DC-DC converter is used as the driving voltage Va supplied to the source of the transistor Tr2 as already explained, and it is unavoidable to some extent that ripple noise (ripple component) is superimposed on the voltage Va, because switching operations are required as an operating principle in this kind of DC-DC converters. Here, when a smoothing capacitor C1 with large capacitance is used, the level of the ripple component can be more reduced in the DC-DC converter, but the reducing effect of the ripple component cannot be expected too much in comparison with the increasing rate of the capacitance.

Especially, not only the increased cost, but also the larger volume for a capacitor is required in order to use the capacitor for a cellular telephone and a personal digital assistance (PDA), though the demand for the display panel shown in FIG. 1 and the DC-DC converter which drives the panel has been grown as a cellular telephone and PDA have been widely used. Accordingly, there is a practical limitation in designing the smoothing capacitor with controlled capacitance to some extent.

Therefore, a driving voltage, which is represent by Va as shown in FIG. 3, on which the ripple component corresponding to the switching period (boosting period Si) of the DC-DC converter is superimposed is supplied to the source of the light-emitting driving transistor Tr2 in the equivalent circuit shown in FIG. 2. On the other hand, the switch SW1 is turned on at addressing (at data writing), and a gate voltage Vgate according to an image signal is supplied to the gate of the driving transistor Tr2.

Here, Ls in FIG. 3 represents one scanning (line) period in the display panel and Fs indicates . . . frame period. As switching is independently operated in the DC-DC converter regardless of one scanning period in the display panel, a writing voltage, which is different among scanning lines in the voltage Vgs between the gate and the source under influence of the ripple component, is written into the capacitor Cs of each pixel.

That is, as shown in FIG. 3, data according to the voltage, which is represented as Vgs1, between the gate and the source is written into the capacitor Cs of each pixel corresponding to, for example, a first scanning line, data according to the voltage, which is represented as Vgs2, between the gate and the source is written to the capacitor Cs of each pixel corresponding to, for example, a second scanning line, and data according to the voltage, which is represented as Vgs3, between the gate and the source is written to the capacitor Cs of each pixel corresponding to, for example, a third scanning line.

FIG. 4 shows a Vgs-Id characteristic (characteristic concerning relation between voltages between the gate and the source, and drain currents) of TFT represented by the transistor Tr2. When the voltage between the gate and the source is changed within a range of delta-Vgs, the drain current is also changed within a range of delta-Id. Here, it has been known that the organic EL element has a characteristic by which the light-emitting intensity is approximately proportional to the current value flowing in the element concerned.

Accordingly, there occurs a state that the values Vgs are different from one another under influence of the ripple component corresponding to the timing of addressing as described above. As a result, each EL element on the light-emitting display panel 1 has different light-emitting intensity for each scanning line. Thereby, there can be presented a problem that the display quality of images is remarkably reduced, for example, a fine striped pattern, or flickering phenomenon is generated on the display panel.

In order to avoid such a problem, there can be an idea that, for example, a regulator circuit shown in FIG. 5 is adopted. That is, the regulator circuit shown in FIG. 5 is inserted between the output terminal of the DC-DC converter and the power supply lines P1, - - - , on the display panel 1. The regulator circuit shown in FIG. 5 comprises: a NPN transistor Q2; an error amplifier including an operational amplifier OP1; and a reference voltage source Vref1. Based on the above configuration, the emitter potential of the NPN transistor Q2 is supplied to a noninverting input terminal of the operation amplifier OP1, and the potential of the reference voltage source Vref1 is supplied to an inverting terminal of the operation amplifier OPI.

According to the configuration, a ripple component generated on the emitter side of the transistor Q2 is output to the error amplifier with the operation amplifier OPI. The base potential of the transistor Q2 is configured to be changed according to the output of the error amplifier. As a result, the emitter side, that is, the Vout side of the transistor Q2 can obtain an output voltage in which the ripple component is almost removed. However, the regulator circuit always causes power loss of (Vin−Vout)×Iout=P[w]. Accordingly, the duration time of a battery is remarkably reduced to cause a state in which it is difficult to adopt the above-described portable equipment.

SUMMARY OF THE INVENTION

The present invention has been made, considering the above-described problems, and its object is to provide a light-emitting display device and a driving control method therefor, by which reduction in display quality of images, which is caused by, for example, a ripple component generated in, for example, a power supply circuit represented by the above-described DC-DC converter can be effectively prevented without increasing the circuit size.

The light-emitting display device according to the present invention, which has been made in order to solve the above-described problems, is characterized in that the display device is provided with a display panel on which multiple pixels comprising a light-emitting element are arranged at intersecting positions of a plurality of scanning lines and a plurality of data lines, wherein the above-described display panel is electrically connected to a section of a circuit structure for a switching operation, and the switching operation in the section of the circuit structure and an operation for scanning selection of scanning lines on the display panel are in synchronization with each other.

Moreover, the driving control method for the light-emitting display device according to the present invention, which has been made in order to solve the above-described problems, is characterized in that the driving control method is for a light-emitting display device provided with a display panel on which multiple pixels comprising a light-emitting element are arranged at intersecting positions of a plurality of scanning lines and a plurality of data lines, wherein, according to the control of the driving method, the display panel is electrically connected to a section of a circuit structure for a switching operation, and the switching operation in the section of the circuit structure and an operation for scanning selection of scanning lines on the display panel are in synchronization with each other.

DESCRIPTION OF PREFERRED EMBODIMENTS

Figure 1:
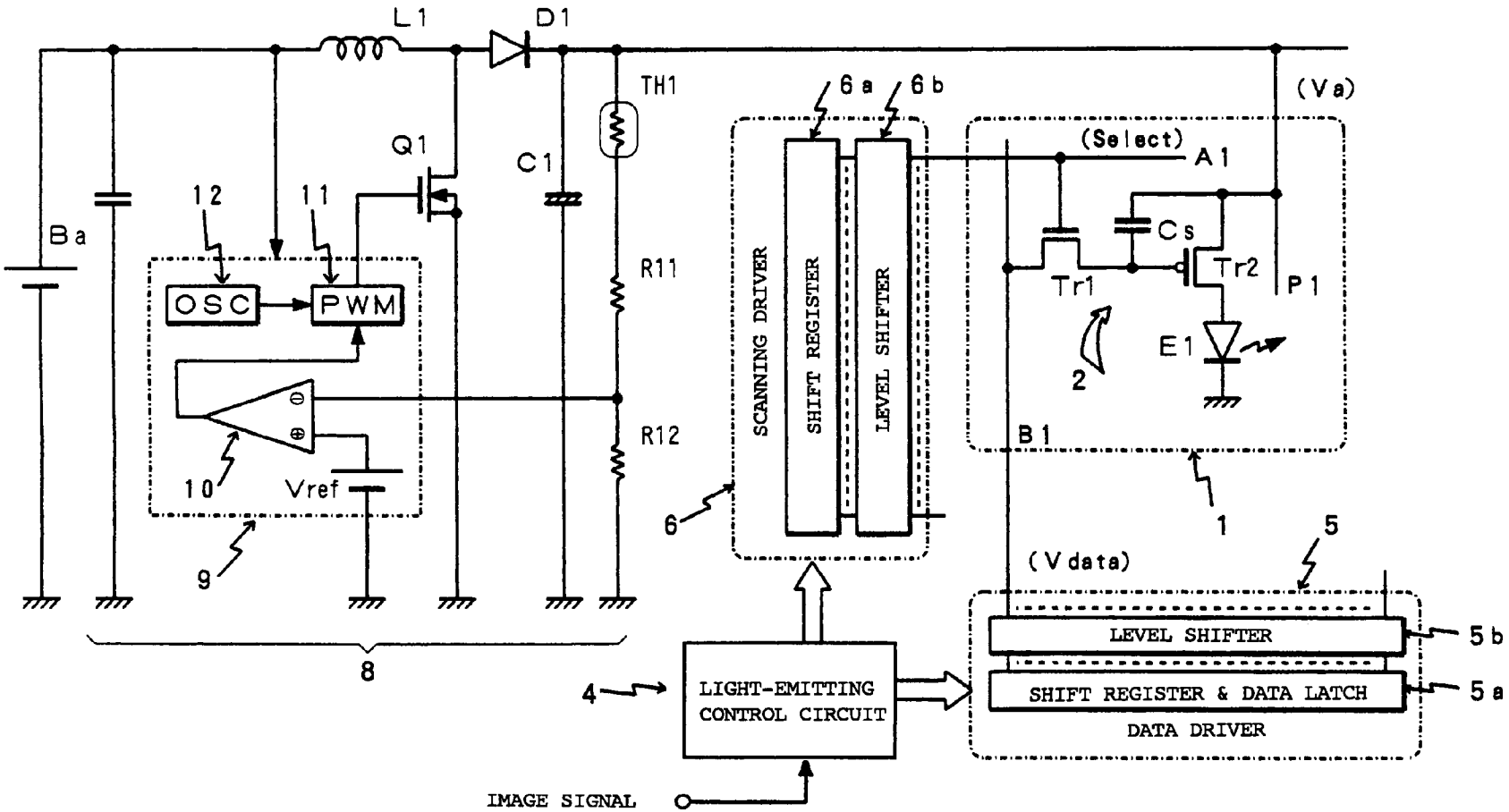
FIG.1 (Prior Art)
FIG. 1 is a connection diagram showing one example of, for example, a circuit structure corresponding to one pixel on a conventional active matrix type display panel, and a power supply circuit which drives the display panel for light-emitting driving.

Hereinafter, a light-emitting display device according to the present invention will be explained based on embodiments shown in FIGS. 6 through 9. Here, components with similar functions to those of components which have been already explained are denoted by the same reference numerals as those of the components, which have been already explained, in the following drawings which will be explained, and detailed description will be adequately eliminated.

Figure 2:
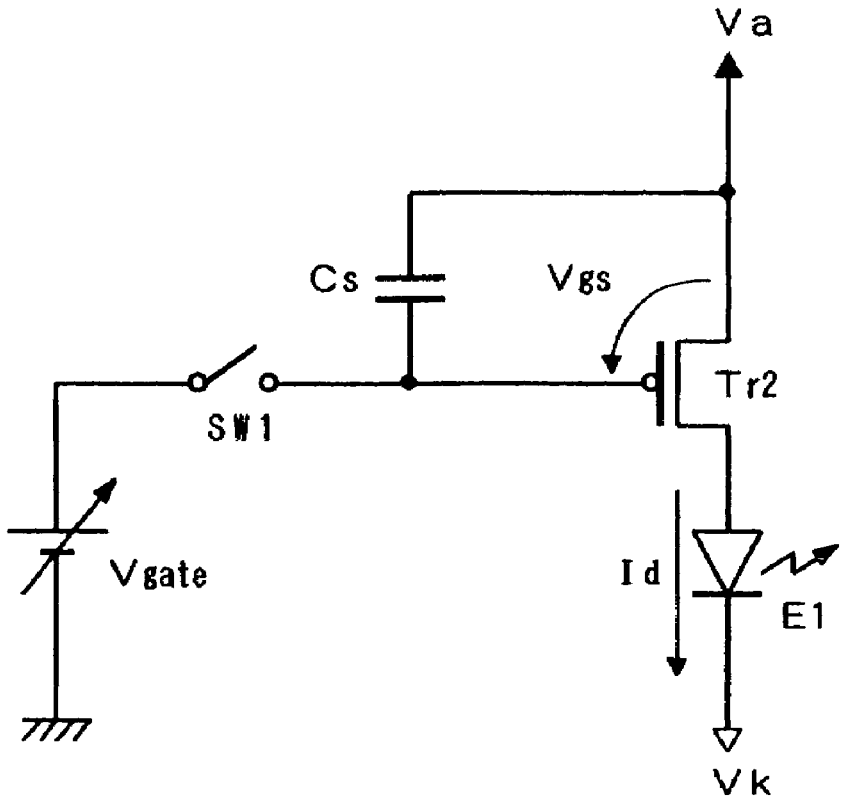
FIG.2 (Prior Art)
FIG. 2 is a drawing of an equivalent circuit for a pixel configuration on the display panel shown in FIG. 1.
Figure 6:
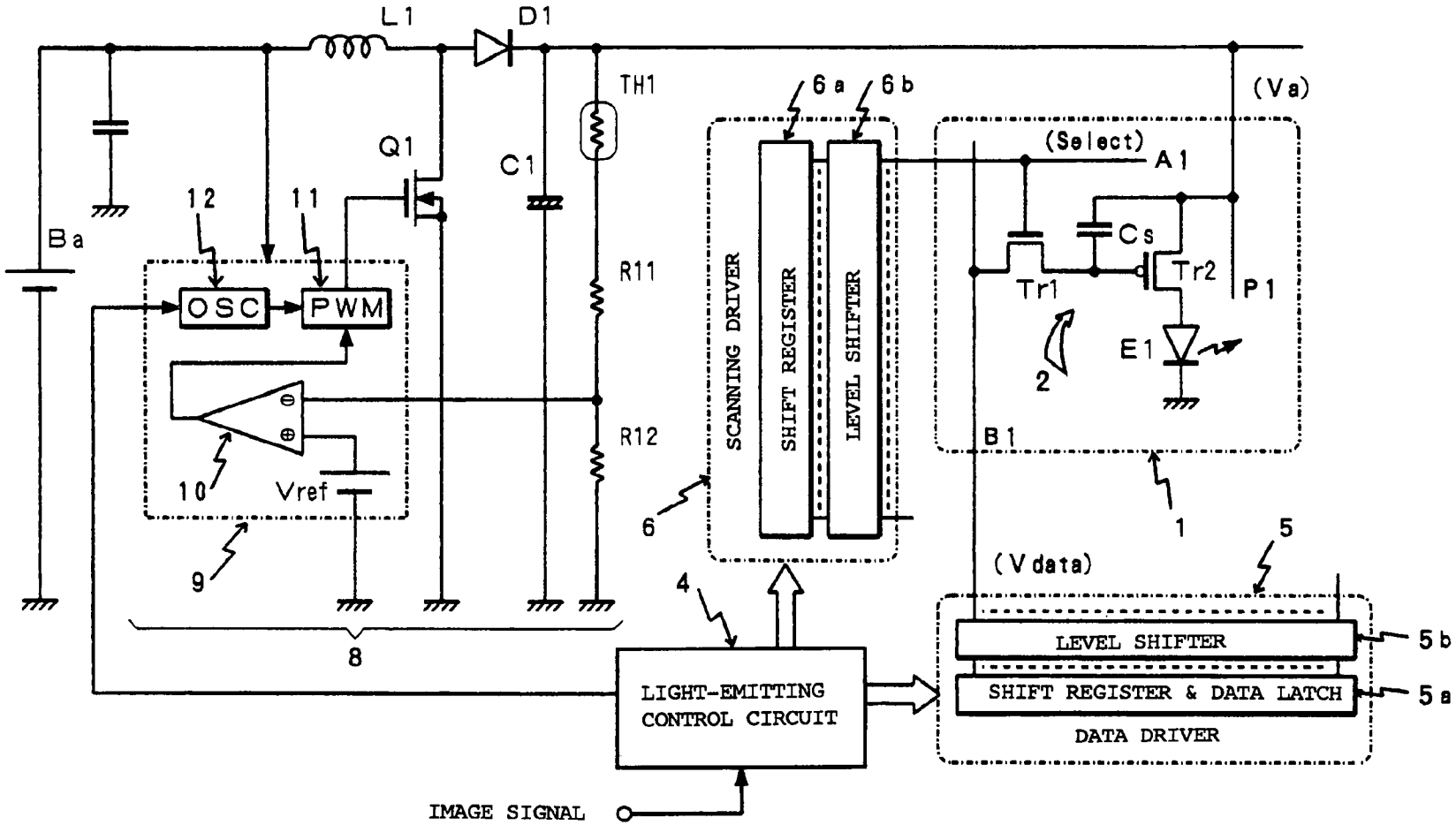
FIG. 6 is a connection diagram showing a first embodiment using the present invention for a pixel configuration driven by a conductance controlled method.

In the first place, FIG. 6 shows a first embodiment in which a display panel 1 having a pixel configuration according to a conductance controlled method is used as shown in FIGS. 1 and 2. Moreover, in this embodiment, the display panel 1 has a configuration in which the panel 1 is electrically connected to a section of a circuit structure for a switching operation, that is, a DC-DC converter 8, and an operating power source voltage Va is supplied from the DC-DC converter 8 concerned to the panel 1. The configuration of the panel 1 is the same as that shown in the example of FIG. 1 which has been already explained.

On the other hand, the embodiment shown in FIG. 6 has a configuration in which a switching operation in the DC-DC converter 8 and an operation for scanning selection of scanning lines in the display panel are in synchronization with each other. That is, a clock signal (scanning shift clock) corresponding to a scanning frequency given from a light-emitting control circuit 4 to the display panel 1 (called a line frequency) is configured to be supplied to an oscillator 12 in the DC-DC converter 8 as shown in FIG. 6.

Thereby, an oscillation output from the oscillator 12 which generates a triangular wave for PWM is in synchronization with the line frequency. Accordingly, in the DC-DC converter 8, a reference signal of the PWM wave supplied to the power FET Q1 also is in synchronization with the line frequency.

Here, considering a relation between the above-described line frequency and a frequency of the switching operation in the DC-DC converter 8 (also called a boosting frequency), a preferable combination meeting requirements of actual conditions is obtained as follows: In the first place, assuming that a display panel with a size of a quarter video graphics array (QVGA) (240×320 dots) size, a 260,000 color display is used as the display panel 1, a number of gradations for control is 10, a sub-frame gradation method is adopted, and a frame frequency is 60 Hz, the following calculation is obtained:

LINE FREQUENCY=FRAME FREQUENCY× NUMBER OF LINES (SCANNING LINES)× NUMBER OF SUB-FRAMES(NUMBER OF GRADATIONS)=60×320×10=192 KHz

It is preferable by the calculation that the boosting frequency is set at a frequency in synchronization with 192 KHz. Here, it is preferable for the DC-DC converter that the boosting frequency is set at a frequency several times (integral multiple) the calculated value, considering the current supplying capacity. Accordingly, it is preferable that the boosting frequency under the above-described conditions are selected among 192 KHz, 384 KHz, 576 KHz, 768 KHz, and 960 KHz. In some cases, there may be a problem that, the boosting capacity of the converter is not enough when this boosting frequency is lower than the above-illustrated frequencies, and a large peak current is caused to load the power supply circuit when the boosting frequency is higher than the above-described frequencies.

Though the above-described calculation example is based on the assumption that the frame frequency is 60 Hz, the following calculation example is obtained when the frame frequency is assumed to be 100 Hz in the above-described conditions:

LINE FREQUENCY=100×320×10=320 KHz

Accordingly, it is preferable that the boosting frequency in this case is selected among 320 KHz, 640 KHz, and 960 KHz.

On the other hand, assuming that the frame frequency is 60 Hz in an example in which the gradation control according to the sub-frame method as described above is not adopted, and the gradation control is executed, depending on a current writing method or a voltage writing method, the following calculation is obtained:

LINE FREQUENCY=60×320=19.2 KHz

Accordingly, the boosting frequency is selected among 192 KHz, 384 KHz, 576 KHz, 768 KHz, and 960 KHz, considering the current supplying capacity the DC-DC converter as described above, though it is preferable that the boosting frequency is set at a frequency in synchronization with 19.2 KHZ which has been obtained by the above-described calculation.

As understood from the examples which have been explained above, using concrete numerical values, a clock signal of, for example, 192 KHz is configured to be supplied from the light-emitting control circuit 4 to the oscillator 12 in a first example according to the sub-frame method under the assumption that the frame frequency is 60 Hz. Then, in the oscillator 12, the boosting frequencies, which are in synchronization with line frequencies, previously illustrated can be obtained, for example, by multiplication of the above signal as required. Moreover, a clock signal of, for example, 320 KHz is configured to be used in a second example according to the sub-frame method under the assumption that the frame frequency is 100 Hz. Furthermore, a clock signal of 19.2 KHz is configured to be used in a similar manner even in a third example according to the current or voltage writing method under the assumption that the frame frequency is 60 Hz.

Figure 3:
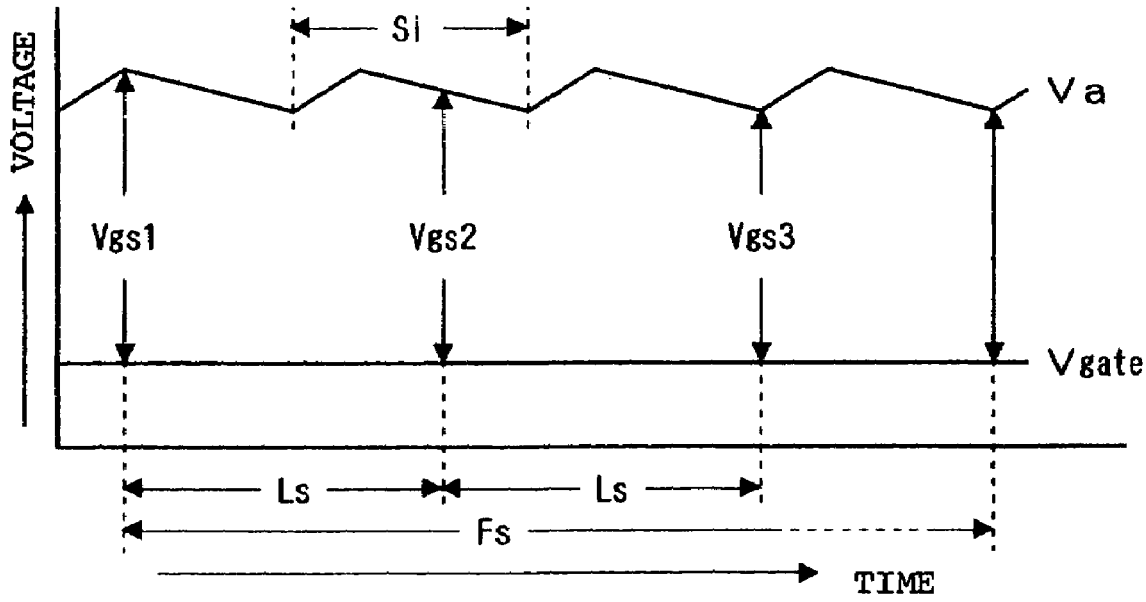
FIG. 3 is a drawing of a signal waveform, which explains a driving voltage applied to the source electrode of a light-emitting driving transistor in the drawing of the equivalent circuit shown in FIG. 2.
Figure 4:
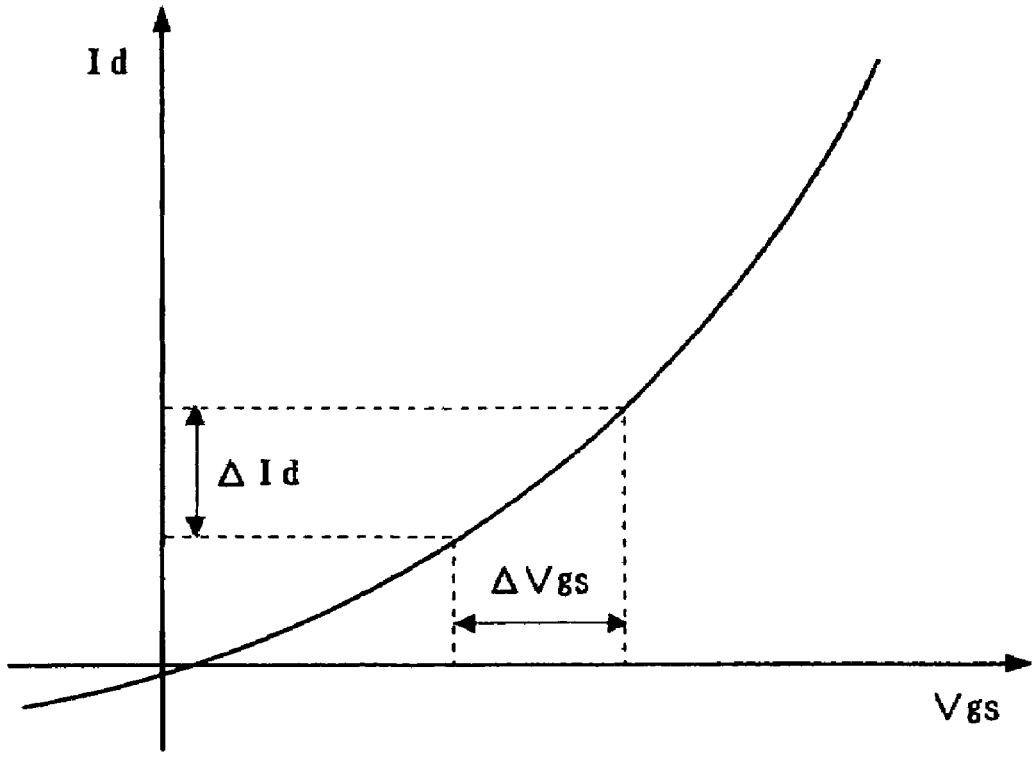
FIG. 4 is a drawing showing a Vgs-Id characteristic of TFT represented by the above-described light-emitting driving transistor shown in FIG. 2.
Figure 5:
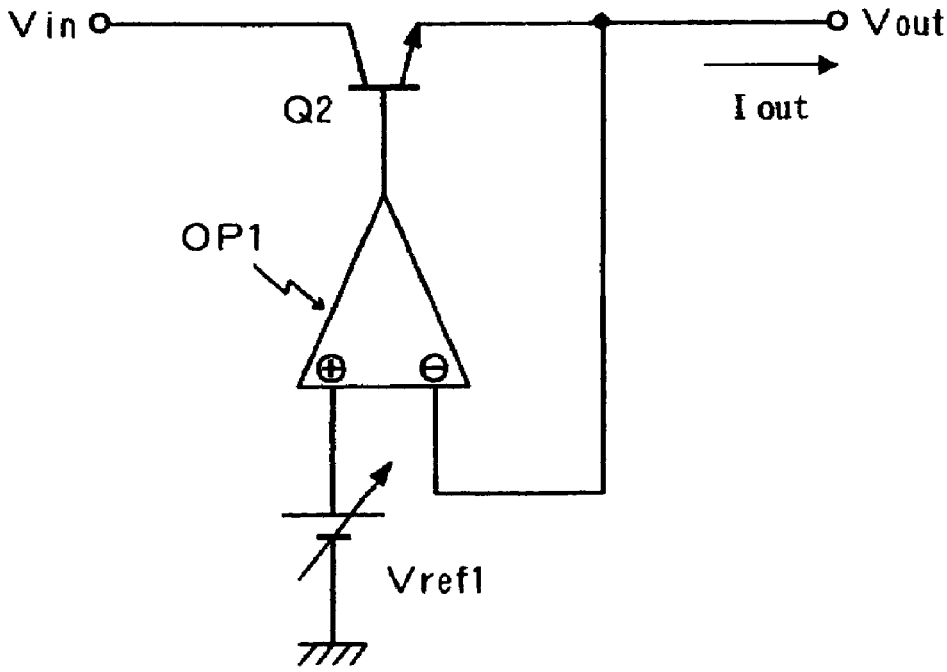
FIG. 5 is a connection diagram showing one example by which malfunctions in the conventional configuration shown in FIG. 1 are eliminated.
Figure 7:
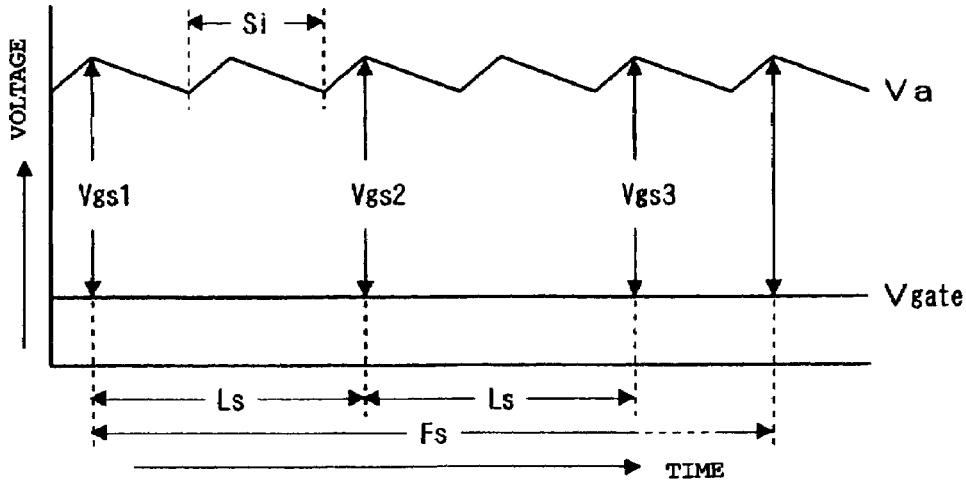
FIG. 7 is a drawing of a signal waveform, which explains operations of the configuration shown in FIG. 6.

FIG. 7 is a timing chart explaining an operation by which the boosting operation in the DC-DC converter is in synchronization with scanning selection of scanning lines on the display panel 1 as explained above. Here, the timing chart shown in FIG. 7 is the same as that shown in FIG. 3 which has already been explained. Va represents a driving voltage on which a ripple component corresponding to a boosting period Si of the DC-DC converter is superimposed. Moreover, Vgate represents a gate voltage according to an image signal supplied to the gate of the driving transistor Tr2 at addressing (at data writing). Moreover, Ls represents one scanning (line) period in a display panel, and Fs represents one frame period.

The example shown in FIG. 7 has a relation by which the line period Ls is twice the boosting period Si, in other words, a boosting frequency is set at a frequency twice a line frequency. Accordingly, data according to the voltage, which is represented by Vgs1, between the gate and the source is written into the capacitor Cs of each pixel corresponding to, for example, the first scanning line, data according to the voltage represented by Vgs2 between the gate and the source is written into the capacitor Cs of each pixel corresponding to the second scanning line, and data according to the voltage represented by Vgs3 between the gate and the source is written into the capacitor Cs of each pixel corresponding to the third scanning line.

As understood from FIG. 7, the timing at data writing every scanning line is in synchronization with the phase of the ripple component which is superimposed on the driving voltage Va. Accordingly, a problem that there is caused a state in which the light-emitting intensity is different every scanning line can be solved because the same voltage Vgs between the gate and the source is supplied every scanning line to the light-emitting driving transistor Tr2 at any time even if the ripple component by switching of the DC-DC converter is superimposed on the driving voltage Va. Thereby, a problem that the display quality of images is remarkably reduced can be prevented in the light-emitting driving operation of the display panel, wherein the operation has a configuration in which the EL element with a light-emitting intensity characteristic of a current dependence type is used as a pixel.

Figure 8:
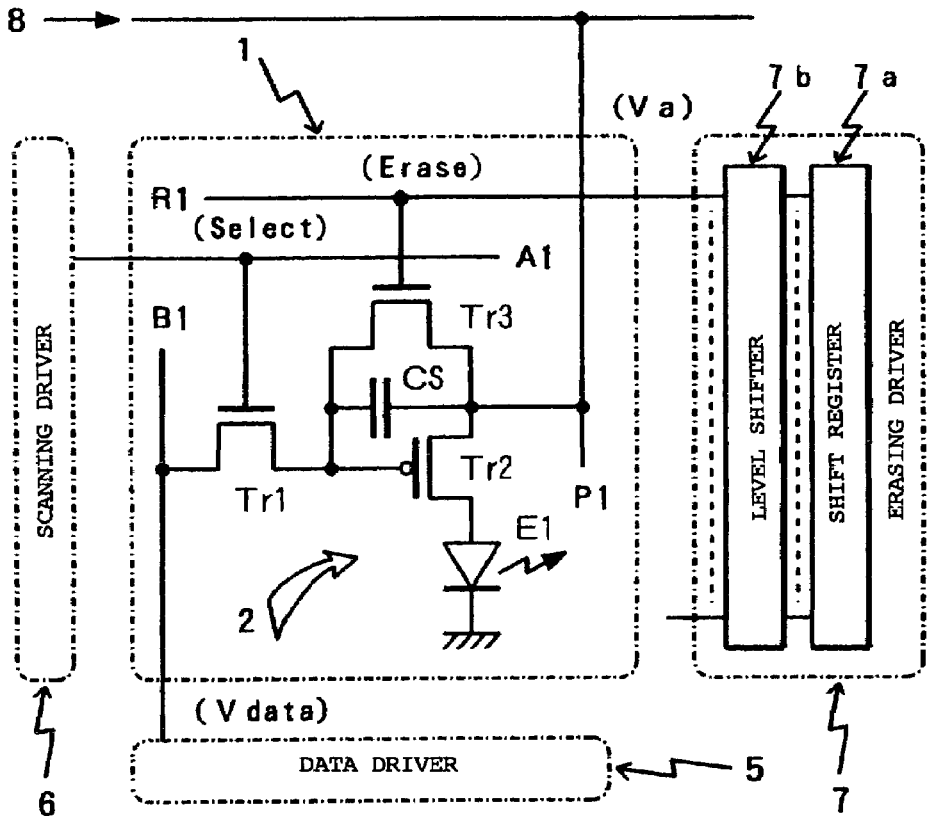
FIG. 8 is a connection diagram showing a second embodiment using the present invention for a pixel configuration driven by a simultaneous erasing scan (SES) method which realizes time-shared gradation expression.

FIG. 8 shows a second embodiment according to the present invention, and this example shows a pixel configuration in which a lighting driving method for time-shared gradation expression, wherein the driving method is called a simultaneous erasing scan (SES) method, is adopted and three TFTs are included. Here, FIG. 8 shows a circuit structure of one display pixel as one representative case on account of limited space, and many circuit structures described above are arranged like a matrix on the display panel 1 shown in FIG. 6.

The circuit structure of the pixel shown in FIG. 8 comprises an erasing transistor Tr3 using TFTs in addition to the pixel configuration of the lighting driving method called the conductance controlled method which has already been explained, referring to FIGS. 1 and 6. Here, in FIG. 8, components corresponding to those which have been already explained, referring to FIGS. 1 and 6 are denoted by the same reference numerals as those in FIGS. 1 and 6, and the block configurations of the data driver 5 and the scanning driver 6 shown in FIGS. 1 and 6 are also omitted.

Moreover, as shown in FIG. 8, the source of the erasing transistor Tr3 is connected to the side of the source of the light-emitting driving transistor Tr2, and the drain is connected to the side of the gate of the driving transistor Tr2. That is, according to the above configuration, the source and the drain of the erasing transistor Tr3 are connected to the ends of the capacitor Cs, respectively, and an erasing signal Erase is supplied from an erasing driver 7 through an erasing signal line R1 arranged on the display panel 1.

According to the function of this erasing driver 7, the erasing signal Erase is supplied from the erasing driver 7 to the erasing transistor Tr3 for ON operation of the transistor Tr3 during the light-emitting period of an EL element E1 forming each pixel, for example, in the middle of one frame period. Thereby, charges accumulated in the capacitor Cs is erased (discharged). In other words, the light-emitting period of the EL element E1 is controlled by controlling the output timing of a gate-ON voltage (erasing signal Erase) from the erasing driver 7 to realize multiple-step gradation expression.

The erasing driver 7 realizing the above-described multiple-step gradation expression comprises a shift register 7*a* to which a shift clock signal and an erasing data signal are supplied from the light-emitting control circuit 4 shown in FIG. 1. The shift clock supplied to this shift register 7*a* is in synchronization with the scanning shift clock supplied to a shift register 6*a*, which has been explained referring to FIG. 1, in the scanning driver 6. Accordingly, shift output from the shift register 7*a* is configured to be supplied to erasing signal lines R1, - - - , corresponding to each scanning line undergoing scanning selection by the scanning driver 6.

At this time, the erasing data signal is superimposed on the shift output from shift register 7*a* in a pulse width modulation (PWM) form. That is, serial erasing data signals supplied to the shift register 7*a* from the light-emitting control circuit 4 shown in FIG. 1 are converted in parallel every the erasing signal lines R1, - - - , using the shift register 7*a*, a level shifter 7*b* converts the erasing data signals after the parallel conversion into those at a predetermined level in such a way that the data signal is supplied to the gate of a erasing transistor Tr3 corresponding to a pixel emitting light.

In the above-described configuration, charges accumulated in the capacitor Cs for charge conservation are discharged by a gate-on operation of the erasing transistor Tr3 according to the vgs/Id characteristic of the erasing transistor Tr3 (characteristic concerning relation between voltages between the gate and the source, and drain currents). In this case, the driving voltage Va including the ripple component given from the above-described DC-DC converter is applied to the source of the erasing transistor Tr3, and a predetermined gate voltage according to the above-described erasing data signal is supplied to the gate of the erasing transistor Tr3.

Accordingly, in the SES configuration shown in FIG. 8, an discharging current erasing charges in the capacitor Cs for charge conservation is changed every line according to the level of the ripple component superimposed on the operating power Va at a point of gate-on of the erasing transistor Tr3. When this discharging current is changed every line, the light-out timing of each pixel according to gradation expression is changed every line to cause a state in which the light-emitting intensity is substantially changed every line according to the ripple component.

Accordingly, even at a light-out operation SES shown in FIG. 8, the configuration causes a problem that the display quality of images is reduced, for example, a fine striped pattern, or flickering phenomenon is generated on the display panel in a similar manner to that of the pixel configuration according to the conductance controlled method which has already been explained.

In order to solve such a problem, there is applied the configuration shown in FIG. 8 in which the clock signal of 192 KHz (in the case of a frame frequency of 60 Hz), or the clock signal of 320 KHz (in the case of a frame frequency of 100 Hz), which are in synchronization with the boosting operation in the DC-DC converter 8 shown in FIG. 6 as described above, is used as a shift clock signal supplied from the light-emitting control circuit 4 to the shift register 7*a* in the erasing driver 7.

Thereby, the switching operation in the DC-DC converter 8 and a starting operation of erasing in the above-described erasing transistor are executed according to a common clock signal. As a result, every line can have the same potential of the ripple component at the erasing operation in the erasing transistor Tr3. This operation is similar to that which has been explained in FIG. 7.

Accordingly, the problem that the light-emitting intensity is substantially changed every line can be solved because Vgs at the erasing operation of the erasing transistor Tr3 can be put into a predetermined value, and the discharging current of charges in the capacitor Cs for charge conservation is changed every line even if the ripple component by the switching operation of the DC-DC converter is superimposed to the driving voltage Va.

Figure 9:
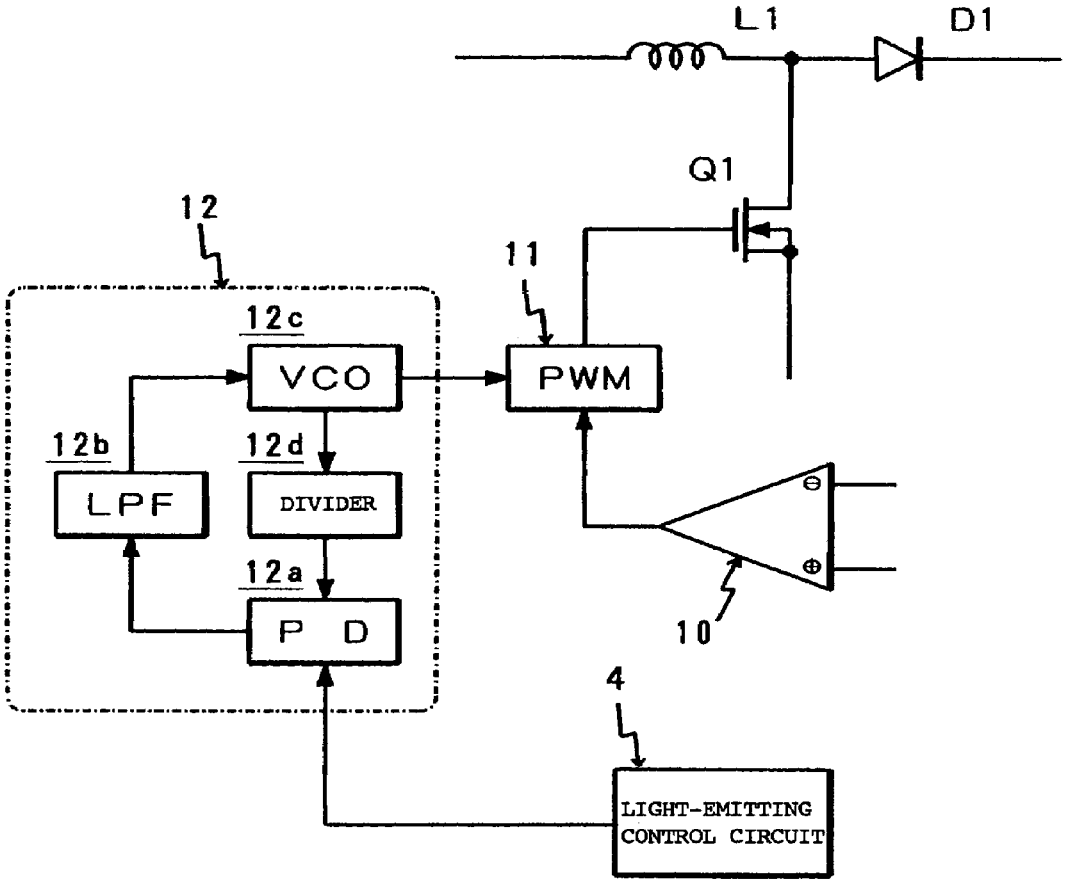
FIG. 9 is a connection diagram showing a third embodiment using the present invention for a switching converter according to a PWM method.

Then, FIG. 9 shows a third embodiment according to the present invention in which a switching regulator circuit in a DC-DC converter is improved. Here, in FIG. 9, components corresponding to those in the DC-DC converter 8 which has been already explained, referring to FIGS. 1 and 6, are denoted by the same reference numerals as those in FIGS. 1 and 6. And, an oscillator 12 in the DC-DC converter shown in FIG. 9 comprises a phase locked loop (PLL) circuit.

The PLL circuit including the oscillator 12 comprises: a phase detector (PD) 12*a* which outputs an error signal corresponding to a phase difference which is obtained by comparison of the phase between a clock signal from a light-emitting control circuit 4 and the divided output of a divider 12*d*; a low-pass filter (LPF) 12*b* which extracts a direct current by receiving the output from the phase detector 12*a*; a voltage control oscillator (VCO) 12*c* in which the oscillation frequency is decided by the direct current obtained through the low-pass filter 12*b*; and the divider 12*d* which divides the output of the voltage control oscillator 12*c* and the divided output is supplied to the phase detector 12*a*.

Accordingly, the oscillating output from the voltage control oscillator 12*c* in synchronization with the clock signal from the light-emitting control circuit 4 can be obtained, and the output of the voltage control oscillator 12*c* is supplied as a reference signal for switching to the PWM circuit 11 in the DC-DC converter.

As shown in FIG. 9, an oscillation output after multiplication of the clock signal from the light-emitting control circuit 4 can be obtained from the voltage control oscillator 12*c*, based on the configuration, in which the oscillator 12 in the DC-DC converter 8 includes the PLL circuit, and on selection of a dividing rate of the divider 12*d*. Accordingly, when the clock signal from the light-emitting control circuit 4 is 192 KHZ (in the case of the frame frequency of 60 Hz) as already illustrated, a reference signal for switching, which is preferably used in the DC-DC converter 8 of 192 KHz, 384 KHz, 576 KHz, 768 KHz, or 960 KHz in synchronization with the clock signal from the light-emitting control circuit 4, can be obtained by adequate selection of the dividing rate of the above-described divider 12*d*.

Here, other light-emitting elements with light-emitting intensity depending on a driving current can be applied, though an organic EL element has been used as a light-emitting element in the above-explained embodiments, Moreover, the present invention can be used for a light-emitting display device using a circuit structure of a pixel according to for example, a current mirror driving method, a current programming driving method, a voltage programming driving method or, a threshold voltage correction method, other than the above-described pixel configuration, though the configurations, which have been illustrated as explained above, of each pixel are typical examples.

What is claimed is:

1. A light-emitting display device provided with a display panel on which multiple pixels including a light-emitting element respectively are arranged at intersecting positions of a plurality of scanning lines and a plurality of data lines, wherein the display panel is electrically connected to a DC-DC converter, and a switching operation by a switching regulator circuit in the DC-DC converter and an operation for scanning selection of scanning lines on the display panel are in synchronization with each other.

2. The light-emitting display device according to claim 1, wherein the frequency of the switching operation by a switching regulator circuit in the DC-DC converter is set at a frequency which is integral multiple of a scanning frequency given to the display panel.

3. The light-emitting display device according to claim 1, wherein each pixel arranged on the display panel comprises at least a light-emitting driving transistor connected to the light-emitting element in series in order to drive the light-emitting element for light-emitting.

4. The light-emitting display device according to claim 2, wherein each pixel arranged on the display panel comprises at least a light-emitting driving transistor connected to the light-emitting element in series in order to drive the light-emitting element for light-emitting.

5. The light-emitting display device according to claim 3, wherein a capacitor for charge conservation which keeps the gate potential of the light-emitting driving transistor is connected to the gate of the light-emitting driving transistor.

6. The light-emitting display device according to claim 4, wherein a capacitor for charge conservation which keeps the gate potential of the light-emitting driving transistor is connected to the gate of the light-emitting driving transistor.

7. The light-emitting display device according to claim 1, wherein the switching operation by a switching regulator circuit in the DC-DC converter and the operation for scanning selection of scanning lines on the display panel are configured to be based on a common clock signal.

8. The light-emitting display device according to claim 7, wherein an erasing transistor which can erase charges in the capacitor for charge conservation is further provided for each pixel, and the switching operation in the section of the circuit structure and a starting operation of erasing in the erasing transistor are executed according to a common clock signal.

9. The light-emitting display device according to any one of claims 1 to 6, wherein the switching operation by a switching regulator circuit in the DC-DC converter is based on a PWM method.

10. The light-emitting display device according to claim 7, wherein the switching operation by a switching regulator circuit in the DC-DC converter is based on a PWM method.

11. The light-emitting display device according to claim 8, wherein the switching operation by a switching regulator circuit in the DC-DC converter is based on a PWM method.

12. The light-emitting display device according to claim 9, wherein a reference signal which executes a switching operation according to the PWM method is configured to use the output of a voltage control oscillator in a PLL circuit, in which a clock signal executing a scanning selection operation in the display panel is used as an input.

13. The light-emitting display device according to claim 10, wherein a reference signal which executes a switching operation according to the PWM method is configured to use the output of a voltage control oscillator in a PLL circuit, in which a clock signal executing a scanning selection operation in the display panel is used as an input.

14. The light-emitting display device according to claim 11, wherein a reference signal which executes a switching operation according to the PWM method is configured to use the output of a voltage control oscillator in a PLL circuit, in which a clock signal executing a scanning selection operation in the display panel is used as an input.

15. A driving control method for a light-emitting display device provided with a display panel on which multiple pixels comprising a light-emitting element are arranged at intersecting positions of a plurality of scanning lines and a plurality of data lines, wherein, according to the control of the driving control method, the display panel is electrically connected to a DC-DC converter, and a switching operation by a switching regulator circuit in the DC-DC converter and an operation for scanning selection of scanning lines on the display panel are in synchronization with each other.

* * * * *